US007380640B1

(12) United States Patent
Kemp et al.

(10) Patent No.: US 7,380,640 B1
(45) Date of Patent: Jun. 3, 2008

(54) LADDER SECURING DEVICE

(76) Inventors: Howard H. Kemp, 3931 SW. 59th Ave., Davie, FL (US) 33314; Timothy Kemp, 3931 SW. 59th Ave., Davie, FL (US) 33314

( * ) Notice: Subject to any disclaimer, the term of this patent is extended or adjusted under 35 U.S.C. 154(b) by 0 days.

(21) Appl. No.: 11/537,361

(22) Filed: Sep. 29, 2006

(51) Int. Cl.
*E06C 7/00* (2006.01)

(52) U.S. Cl. ..... 182/107

(58) Field of Classification Search ..... 182/107; 81/367, 368, 370, 372, 373, 375, 378, 418; D8/52

See application file for complete search history.

(56) References Cited

U.S. PATENT DOCUMENTS

| | | | | |
|---|---|---|---|---|
| 2,519,630 | A * | 8/1950 | Boyer | 81/373 |
| 2,904,128 | A * | 9/1959 | Galen et al. | 182/108 |
| 2,999,290 | A * | 9/1961 | Giles | 248/237 |
| 4,924,971 | A | 5/1990 | Rice | |
| 5,078,231 | A | 1/1992 | Davis | |
| 5,215,163 | A | 6/1993 | Kent, Sr. et al. | |
| 5,509,500 | A | 4/1996 | Delagers | |
| 5,549,261 | A | 8/1996 | Hardin | |
| D406,652 | S | 3/1999 | Marchand | |
| 6,276,039 | B1 * | 8/2001 | Barnes | 29/402.05 |
| 6,354,401 | B2 | 3/2002 | Murray | |
| 6,427,803 | B1 | 8/2002 | Moore | |
| 6,550,577 | B1 * | 4/2003 | Allgire | 182/107 |
| 6,805,221 | B1 | 10/2004 | Lee | |
| 2003/0188924 | A1 * | 10/2003 | Bamber | 182/107 |
| 2004/0055820 | A1 * | 3/2004 | Charlton | 182/107 |
| 2006/0248990 | A1 * | 11/2006 | Bertholf et al. | 81/367 |

* cited by examiner

*Primary Examiner*—Alvin C Chin-Shue
(74) *Attorney, Agent, or Firm*—Advantia Law Group; Michael W. Starkweather; Jason P. Webb

(57) ABSTRACT

A ladder securing device for securing an extension ladder to a structure. The device includes: a first U-shaped clamping member; a second U-shaped clamping member slidably coupled to the first clamping member; a first plate member fixedly coupled to the first U-shaped clamping member; a second plate member fixedly coupled to the second U-shaped clamping member; a first gripping portion pivotally coupled to the first clamping member; a second gripping portion having an adjustable screw therein, and pivotally coupled to the second clamping portion; a first flexible securing member and flexible second securing coupled to the first clamping member, wherein each are configured to extend outward from the first clamping member and be wrapped around an extension ladder; a first fastening mechanism coupled to the first flexible securing member; and a second fastening mechanism coupled to the second securing member, and removably coupleable to the first fastening mechanism.

10 Claims, 2 Drawing Sheets

LADDER SECURING DEVICE

BACKGROUND OF THE INVENTION

1. Field of the Invention

The present invention relates to ladder securing devices, specifically ladder securing devices for securing extension ladders to a structure.

2. Description of the Related Art

In the related art, it has been known to use devices to ensure the safe and secure use of a ladder to thereby prevent personal injury and property damage. Many people use ladders to access locations of varying elevation. Ladders are used to access elevated locations as well as to support a person while they perform an activity at some elevation. The greater the elevation to be accessed the greater the risk of injury posed to users and/or third persons proximate to the ladder. Injury caused by the ladder becoming unstable and falling from the structure to the ground. Therefore there is a need for a ladder security device that affordably, effectively, and efficiently enables a user to safely and securely use a ladder. Some improvements have been made in the field. Examples include but are not limited to the references described below, which references are incorporated by reference herein:

U.S. Pat. No. 6,354,401, issued to Murray, discloses a U-shaped channel member fitted horizontally over a gutter, with each protruding channel member engaging the fascia board to which the gutter is attached. Ladder legs rest against the channel member between brackets. A strap attached to the channel member is adapted to engage a ladder rung with the gutter, thereby holding the ladder in engagement with the channel member and further preventing the ladder from sliding laterally or diagonal movement.

U.S. Pat. No. 5,549,261, issued to Hardin, discloses a brace for a gutter including a support which is sized and shaped to fit within a gutter, at least two ferrules and at least one fastener for each ferrule. The at least two ferrules being of a larger inner diameter than an outer diameter of said at least one fastener. The support contains at least two sets of holes, each set of holes being defined in said support. One hole is of a first size such that a fastener can pass through it but a ferrule cannot and the other hole is of a second size that both a fastener and a ferrule can pass through. The holes are parallel to each other and the centers of the holes are opposite each other. The ferrule is inserted into said hole of first size allowing the ferrule to pass through it. The fastener is inserted into the hole of second size and passes through the support into the hole of first size and through the ferrule.

U.S. Pat. No. 5,215,163, issued to Kent, Sr. et al., discloses a ladder support for mounting on the fascia board of a structure and securing the top end of a ladder to facilitate access to the roof of a structure. In a preferred embodiment the ladder support includes a pair of spaced legs extending outwardly and upwardly in spaced relationship from fixed attachment to the fascia board and a crossbar connecting the extending legs intermediate the ends of the legs. The angle of extension of the legs facilitates clearance of any gutter which might also be mounted on the fascia board of the structure and allows placement of the top segment of the ladder against the crossbar to support the ladder at a safe angle with respect to the supporting surface. In another preferred embodiment a sliding bracket is mounted on the crossbar and is fitted with a thumb screw for locking the bracket against one leg of the ladder and further securing the ladder on the crossbar.

U.S. Pat. No. 5,078,231, issued to Davis, discloses a base plate includes a plurality of plate members, each formed with abutting flanges that are in turn orthogonally oriented relative to one another to provide a continuous abutment surface for a plurality of ladder legs of an associated ladder. The structure includes pins directed through each corner of the free ends of the base plates, and may further be provided with tether lines, with a plurality of the tether lines utilizing adjusting means for fixedly anchoring the ladder to the plate structure. Further refinement of the organization includes the flanges in hingedly intercommunicating relationship relative to one another to permit interfolding of the structure for ease of transport and storage.

U.S. Pat. No. 6,805,221, issued to Lee, discloses a ladder has side rails with rungs and lower eye-bolts extending from the side rails. A bracket is coupleable to a building to be painted or maintained with upper eye-bolts. A pair of turnbuckles have central sections, upper end sections and lower end sections. A pair of J-shaped hooks have lower ends. The lower ends are coupled to the upper ends of the turnbuckle. An upper hook-shaped end is removably coupled to an upper eye-bolt. A pair of short chains has upper ends threadedly coupled to the lower end of the turnbuckle. A lower hook-shaped end is removably coupled to a lower eye-bolt.

U.S. Pat. No. 5,509,500, issued to Delagera, discloses a gutter guard protector and anti-slip ladder device for a roof on a building comprising an assembly that is insertable into the gutter, for preventing the top portions of the side rails of the ladder from crushing the front segment of the gutter when placed against it. A structure on the assembly is for preventing the top portion of the side rails of the ladder from sliding off when placed thereagainst.

U.S. Pat. No. 4,924,971, issued to Rice, discloses a ladder safety apparatus for use with a straight ladder having vertical side rails, and having horizontally aligned openings in the side rails, is disclosed. An example is a hollow-rung metal or aluminum ladder. The safety apparatus includes a flexible metal cable of a length somewhat greater than the rail-to-rail dimension of the ladder, the cable extending through the openings in the side rails. An elongated metal bolt or tube is non-removably attached to each end of the metal cable, to thereby form a linear extension of the metal cable. First and second building attachment means are provided, each such means having a metallic cable-attachment portion with an opening therein whereby the building attachment means is slidably and loosely mounted on the bolt or tube. An adjustment nut or collet is mounted on the bolt or tube, and in a position to adjustably trap the cable-attachment portion on an end of the metal cable. The metal cable includes a protective plastic covering.

U.S. Pat. No. 6,427,803, issued to Moore, discloses a ladder safety system for secures the upper end of an extension ladder to the roof, eave, or wall of a building. For each ladder rail there is a rail-mountable bracket member that removably mounts onto the rail, a rigid plate member that removably attaches onto the building, and an adjustable strut or arm. Each of the bracket member and the plate member has an eye or ring affixed onto it, and the strut joins the eye member of the bracket member to the eye member of the plate member. The plate member articulates on the strut to permit it to be oriented to attach to any convenient horizontal, vertical or sloping surface.

U.S. Design Pat. No.: 406,652, issued to Marchand, discloses the ornamental design for an adjustable ladder stabilizer.

The inventions heretofore known suffer from a number of disadvantages which include expensive, limited in application, limited in versatility, cumbersome, difficult to use/assemble, inconvenient and/or otherwise fails to provide an easily adaptable, durable and/or cost effective means to secure a ladder to a structure for safe use.

What is needed is a ladder securing device that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available ladder securing devices. Accordingly, the present invention has been developed to provide a ladder securing device for securing an extension ladder to a structure.

In one embodiment of the present invention, there is a ladder securing device for securing an extension ladder to a structure. The device may include: a first U-shaped clamping member that may have a slit therein; a second U-shaped clamping member that may be slidably coupled to the first clamping member at the slot in the first clamping member, a first plate member that may be fixedly coupled to, and/or may be near an end of the first U-shaped clamping member; a second plate member that may be fixedly coupled to, and/or may be near an end of the second U-shaped clamping member; and/or a first gripping portion that may be pivotally coupled to the first clamping member; and/or second gripping portion that may be pivotally coupled to the second clamping portion.

There may also be a first flexible securing member that may be coupled to a side of the first clamping member and/or a second flexible securing member that may be coupled to a side of the first clamping member, opposite the first flexible securing member. The first securing member and/or second securing member may be configured to extend outward from the first clamping member and/or may be wrapped around an extension ladder. Further, the device may include: a first fastening mechanism that may be coupled to, and/or may be near an end of the first flexible securing member; and/or a second fastening mechanism that may be coupled to, and/or may be near an end of the second flexible securing member.

In another embodiment of the present invention, the ladder securing device may include: a first plate member and/or second plate member, wherein each may be substantially square shaped; and/or a second gripping portion that may have a adjustable screw therein.

In yet another embodiment of the present invention, the ladder securing device may include: a first securing member and/or second securing member, wherein each may be in the form of a chain; and/or a first fastening member and/or second fastening member, wherein each may be in the form of clips.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
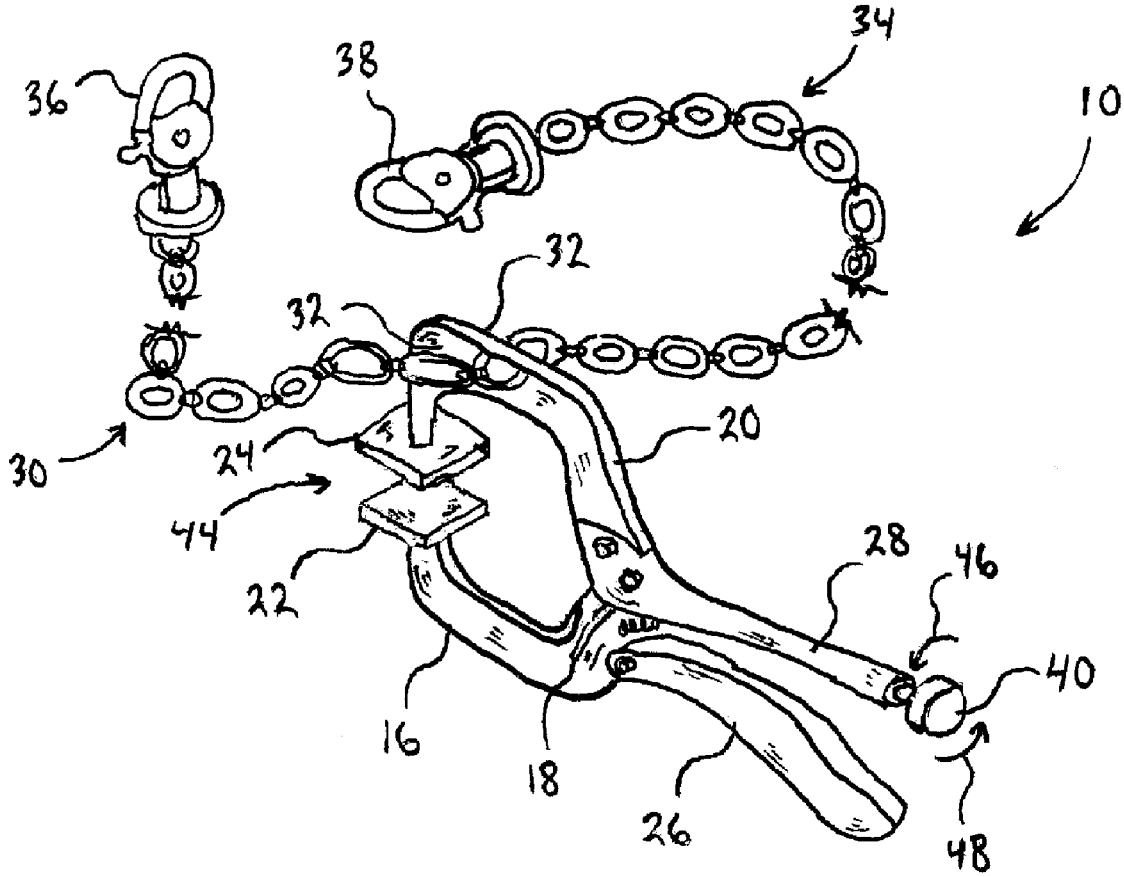
FIG. 1 is a front perspective view of a ladder securing device, according to one embodiment of the present invention.
Figure 2:
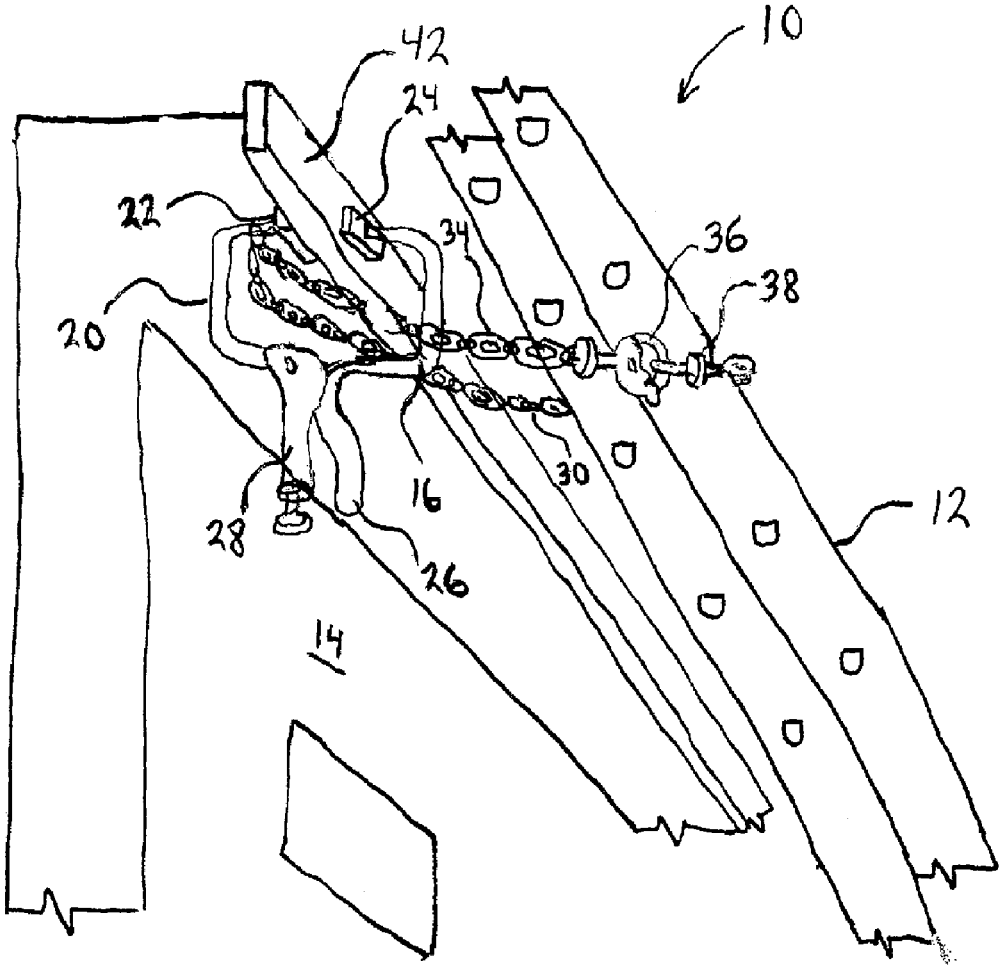
FIG. 2 is a side perspective view of a ladder securing device securing a ladder to a structure, according to one embodiment of the present invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, etc. does not mean that the features are related, dissimilar, the same, etc. The use of the term "an embodiment," or similar wording, is merely a convenient phrase to indicate optional features, which may or may not be part of the invention as claimed.

Each statement of an embodiment is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The independent embodiments are considered to be able to be combined in whole or in part one with another as the claims and/or art may direct, either directly or indirectly, implicitly or explicitly.

Finally, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

Looking to the figures, there is an embodiment of a ladder securing device 10 for securing an extension ladder 12 to a structure 14. The device, as shown, includes: a first U-shaped clamping member 16 having a slot 18 therein; a second U-shaped clamping member 20 slidably coupled to the first clamping member at the slot in the first clamping member; a first plate member 22 fixedly coupled to, and near an end of the first U-shaped clamping member; a second plate member 24 fixedly coupled to, and near an end of the second U-shaped clamping member; a first gripping portion 26 pivotally coupled to the first clamping member; a second gripping portion 28 pivotally coupled to the second clamping portion. As shown in FIG. 1, in the open position where the plate members are further away from each other, the second clamping member is configured to slide to toward the right end of slot 18, as indicated in arrow 50. Likewise, in the closed position where the plate members are close to each other, the second clamping member is configured to slide to toward the left end of slot 18, as indicated in arrow 50.

There is also shown: a first flexible securing member 30 fixedly coupled to a side 32 of the first clamping member; a second flexible securing member 34 coupled to a side 32 of the first clamping member, opposite the first flexible securing member, and configured to extend outward from the first clamping member and be wrapped around an extension ladder 12; a first fastening mechanism 36 coupled to, and near the end of the first flexible securing member; and a second fastening mechanism 38 coupled to, and near an end of the second securing member, and removably coupleable to the first fastening mechanism.

In one embodiment, the ladder securing device 10 includes: plate members 22, 24 being substantially square shaped; the gripping portion 28 having an adjustable screw 40 disposed therein. In alternative embodiments, there may be rubber coated pads coupled to the plate members, thereby preventing the fascia board or beam 42 from being scratched or damaged.

In yet another embodiment, the ladder securing device 10 includes: a pair of flexible securing members 30, 34 in the form of chains; and a pair of fastening mechanisms 36, 38 in the form of clips.

In operation, a user performing construction or maintenance work would position the extension ladder 12 upward against the building structure 14. The user then could climb the ladder while holding the ladder securing device 10. Once the user reaches a certain height and is in close proximity to a horizontal fascia board or beam 42 coupled to the structure, he or she can wrap the first flexible securing member 30 around one side rail of the ladder 12 and wrap the other securing member 34 around the other side rail of the ladder. Next, the user can removably couple the securing members 30, 34 together via the fastening mechanisms 36, 38. The user then user may grab the gripping portions 26, 28 and position the device in such a manner, such that the beam 42 is in the gap 44 between plate members 22, 24. At this point, the user can twist the adjustable screw 40 clockwise, as indicated by top arrow 46, until the plate members are securely engaged with the beam from both sides.

Once the plate members 22, 24 are tightly engaged with the beam 42, the device 10 is considered to be securing the ladder 12 to the building structure. Upon completion of the construction or maintenance work, the user could disengage the plate members from the beam 42 by twisting the adjustable screw 40 counter-clockwise, as indicated by bottom arrow 48. The user could then lower the ladder 12 and remove such from the building structure 14.

The illustrated embodiment of the ladder securing device 10 fulfills the need for a ladder accessory that would prevent an extension ladder 12, engaged with a structure 14, from shifting, which in turn would minimize the chance of falls and related injuries. As a result, one user would no longer have to hold the ladder 12 while another user climbs the ladder. The safety related to the device would provide a financial benefit to construction workers, maintenance personnel, window cleaners, etc. through reduce insurance premiums and workers' compensation claims.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claim rather than by the foregoing description. All changes which come within the meaning and range of equivalency of the claims are to be embraced within their scope.

Although the figures illustrate the clamping members 16, 20 being U-shaped, one skilled in the art would know the clamping members may be shaped different, according to various embodiments. For example, are shaped, rectangular shaped, etc.

Additionally, although the figures illustrate the securing members 30, 34 being in the form of chains, one skilled in the art would know that the securing members may be formed of different material, according to alternative embodiments. For example, rope, metal cable, etc.

Further, although the figures illustrate the fastening mechanisms 36, 38 being in the form of clips, one skilled in the art would know that the fastening mechanisms be removably coupleable together by different means, according to various embodiments. For example, hooks, etc.

It is expected that there could be numerous variations of the design of this invention. An example is that the clamping members 16, 20; slot 18; plate members 22, 24; gripping portions 26, 28; securing members 30, 34; fastening mechanisms 36, 38; and/or adjustable screw 40 may be of varying length, width, shape, size, diameter, etc. to accommodate different configurations of building structures 14.

Finally, it is envisioned that the components of the device may be constructed of a variety of materials, such as metal, steel, metal alloys, etc.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A ladder securing device for securing an extension ladder to a structure, comprising:

a first U-shaped clamping member having a slot therein;

a second U-shaped clamping member slidably coupled to the first U-shaped clamping member at the slot in the first U-shaped clamping member;

a first plate member, fixedly coupled to, and near an end of the first U-shaped clamping member;

a second plate member, fixedly coupled to, and near and end of the second U-shaped clamping member;

a first gripping portion, pivotally coupled to the first U-shaped clamping member;

a second gripping portion, pivotally coupled to the second U-shaped clamping member;

a first flexible securing member coupled to a side of the first U-shaped clamping member, and configured to extend outward from the first U-shaped clamping member and be wrapped around an extension ladder;

a second flexible securing member coupled to a side of the first U-shaped clamping member, opposite the first flexible securing member; and configured to extend outward from the first U-shaped clamping member and be wrapped around an extension ladder;

a first fastening mechanism coupled to, and near an end of the first flexible securing member; and a second fastening mechanism coupled to, and near an end of the second flexible securing member, and removably coupleable to the first fastening mechanism.

2. The ladder securing device of claim 1, wherein the first plate member and second plate member are substantially square shaped.

3. The ladder securing device of claim 2, wherein the second gripping portion includes an adjustable screw therein.

4. The ladder securing device of claim 3, wherein the first flexible securing member and second flexible securing member are chains.

5. The ladder securing device of claim 4, wherein the first fastening mechanism and second fastening mechanism are clips.

6. A ladder securing device for securing an extension ladder to a structure, consisting essentially of:

a first U-shaped clamping member having a slot therein;

a second U-shaped clamping member slidably coupled to the first U-shaped clamping member at the slot in the first U-shaped clamping member;

a first plate member fixedly coupled to, and near an end of the first U-Shaped clamping member;

a second plate member fixedly coupled to, and near and end of the second U-shaped clamping member;

a first gripping portion pivotally coupled to the first U-shaped clamping member;

a second gripping portion pivotally coupled to the second U-shaped clamping member;

a first flexible securing member coupled to a side of the first U-shaped clamping member, and configured to extend outward from the first U-shaped clamping member and be wrapped around an extension ladder;

a second flexible securing member coupled to a side of the first U-shaped clamping member, opposite the first flexible securing member, and configured to extend outward from the first U-shaped clamping member and be wrapped around an extension ladder;

a first fastening mechanism coupled to, and near an end of the first flexible securing member; and a second fastening mechanism coupled to, and near an end of the second flexible securing member, and removably coupleable to the first fastening mechanism.

7. The ladder securing device of claim 6, wherein the first plate member and second plate member are substantially square shaped.

8. The ladder securing device of claim 7, wherein the second gripping portion includes an adjustable screw therein.

9. The ladder securing device of claim 8, wherein the first flexible securing member and second flexible securing member are chains.

10. The ladder securing device of claim 9, wherein the first fastening mechanism and second fastening mechanism are clips.

* * * * *